US009243631B2

(12) United States Patent
Patton

(10) Patent No.: US 9,243,631 B2
(45) Date of Patent: Jan. 26, 2016

(54) SYSTEM AND METHOD FOR MONITORING PUMP LINING WEAR

(75) Inventor: Kenneth Patton, Waxhaw, NC (US)

(73) Assignee: IMO Industries, Inc., Lawrenceville, NJ (US)

( * ) Notice: Subject to any disclaimer, the term of this patent is extended or adjusted under 35 U.S.C. 154(b) by 216 days.

(21) Appl. No.: 13/432,563

(22) Filed: Mar. 28, 2012

(65) Prior Publication Data

US 2012/0258000 A1 Oct. 11, 2012

Related U.S. Application Data

(60) Provisional application No. 61/472,984, filed on Apr. 7, 2011.

(51) Int. Cl.
*F04C 28/28* (2006.01)
*F04C 2/16* (2006.01)
*F04C 14/28* (2006.01)

(52) U.S. Cl.
CPC ..... *F04C 2/165* (2013.01); *F04C 14/28* (2013.01); *F04C 2240/802* (2013.01); *F04C 2240/81* (2013.01); *F04C 2270/16* (2013.01); *F04C 2270/86* (2013.01)

(58) Field of Classification Search
CPC ..... G01N 3/56
USPC ..... 73/7
See application file for complete search history.

(56) References Cited

U.S. PATENT DOCUMENTS

| | | | | |
|---|---|---|---|---|
| 3,996,124 | A | 12/1976 | Eaton et al. | |
| 4,535,326 | A | 8/1985 | Mullins et al. | |
| 4,655,077 | A | 4/1987 | Purvis et al. | |
| 5,348,453 | A * | 9/1994 | Baran et al. | 417/440 |
| 5,601,414 | A | 2/1997 | Dire | |
| 7,677,079 | B2 * | 3/2010 | Radziszewski et al. | 73/7 |
| 2003/0113221 | A1 | 6/2003 | Wagner et al. | |
| 2008/0193309 | A1 | 8/2008 | Kothnur et al. | |

FOREIGN PATENT DOCUMENTS

| | | | |
|---|---|---|---|
| DE | 102009056119 | A1 | 7/2010 |
| WO | 2005083411 | A1 | 9/2005 |
| WO | 2009/143232 | A1 | 11/2009 |

OTHER PUBLICATIONS

International Search Report/Written Opinion for PCT/US2012/030901, dated Jun. 28, 2012.

Supplementary European Search Report dated Sep. 22, 2014, European Patent Application No. 12768485 filed Apr. 7, 2011.

* cited by examiner

*Primary Examiner* — Hezron E Williams

*Assistant Examiner* — Mark A Shabman

(74) *Attorney, Agent, or Firm* — Kacvinsky Daisak Bluni PLLC

(57) ABSTRACT

A system for monitoring wear of pump casing liners is disclosed. The system may include a wear sensor disposed in proximity to the pump casing liner so that the sensor wears at substantially the same rate as the lining. The wear sensor may include a plurality of circuit loops having different lengths. As the pump casing liner and the sensor wear during use, the plurality of circuit loops are sequentially breached. A control system monitors the signals from the plurality of circuit loops to develop liner wear information. This information is employed to signal a user when one or more predetermined wear thresholds are exceeded.

13 Claims, 8 Drawing Sheets

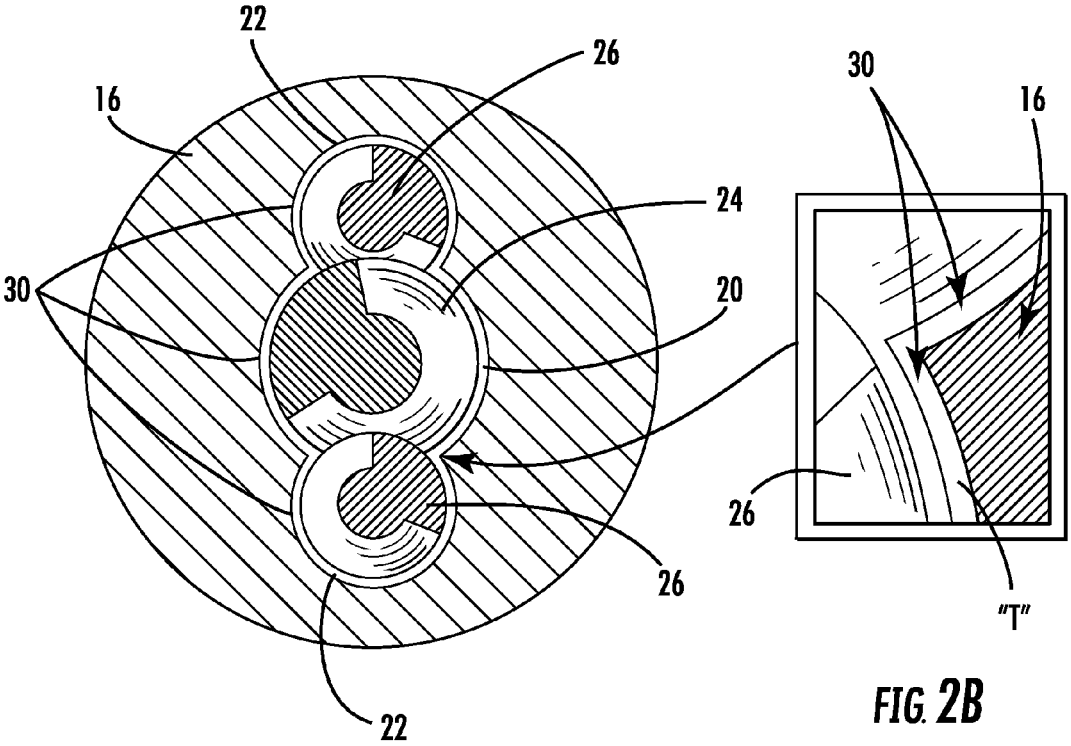
FIG. 2B
FIG. 2A
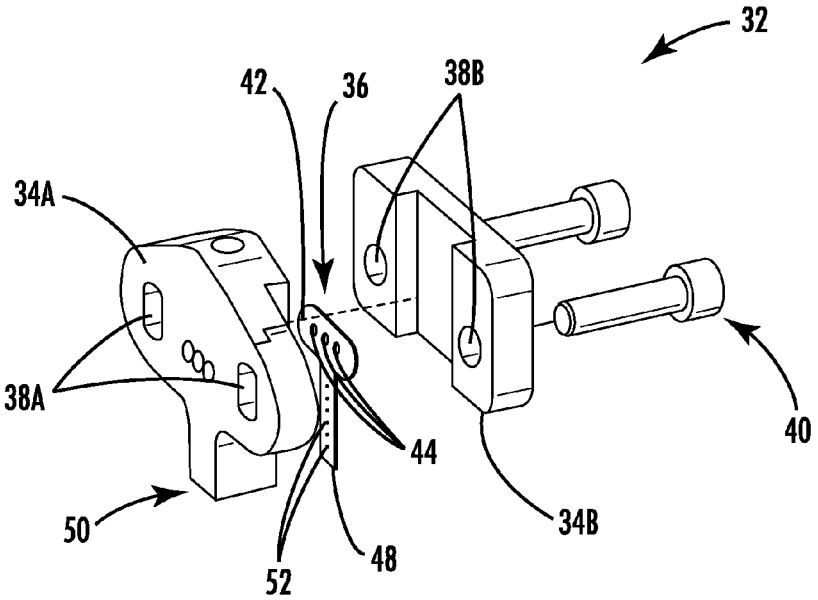
FIG. 3

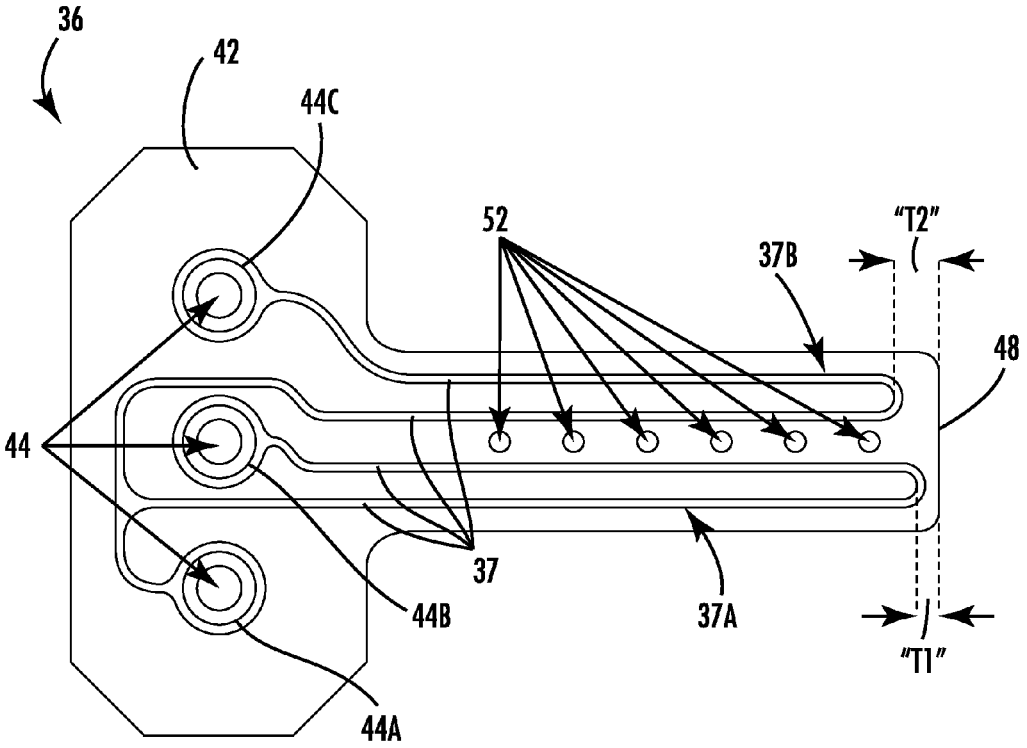
FIG. 5
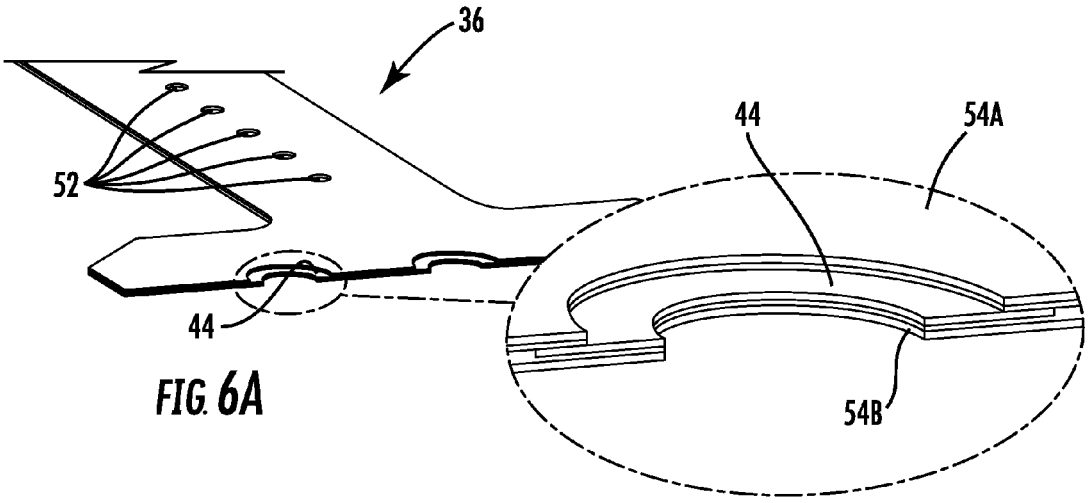
FIG. 6A
FIG. 6B

SYSTEM AND METHOD FOR MONITORING PUMP LINING WEAR

CROSS-REFERENCE TO RELATED APPLICATIONS

This is a non-provisional of pending U.S. Provisional Patent Application Ser. No. 61/472,984, filed Apr. 7, 2011, the entirety of which application is incorporated by reference herein.

FIELD OF THE DISCLOSURE

The disclosure is generally related to the field of fluid handling systems, and more particularly to an improved system for monitoring wear of pump linings.

BACKGROUND OF THE DISCLOSURE

Screw pumps are rotary, positive displacement pumps that use two or more screws to transfer high or low viscosity fluids or fluid mixtures along an axis. Generally, a three-screw pump is a positive rotary pump in which a central one of three screws is motor-driven, and the two further screws are idlers meshing with diametrically opposed portions of the driven central screw, the idlers acting as sealing elements that are rotated hydraulically by the fluid being pumped. The volumes or cavities between the intermeshing screws and a liner or casing transport a specific volume of fluid in an axial direction around threads of the screws. As the screws rotate the fluid volumes are transported from an inlet to an outlet of the pump. In some applications, these pumps are used to aid in the extraction of oil from on-shore and sub-sea wells.

Often the liquids pumped through these pumps include entrained solids, such as sand. The presence of sand and other solids can cause damage to the pump internals, most notably to the pump casing, where the solids can pass between the screws and the casing. Substantial wear of the pump casing can undesirably result in reduced discharge flow rates. Repair of pump casings can be expensive, and thus, many manufacturers line the pump casing with a self-repairing liner material. Such liners are typically made from material that is much softer than the casing and screws. Thus, damage due to entrained solids is borne by the liner and not the more expensive casing. Such liners may be "self-repairing," in that over time, scratches and gouges caused by contact with entrained solids may be smoothed over, mitigating their impact on performance of the pump.

While such liners can improve pump lifecycle, periodic liner refurbishment is still required. A difficulty remains, however, in determining when liner replacement should occur. As noted, liner degradation may manifest itself in reduced output flow from the pump. Where multiple pumps serve a single outlet, however, it can be difficult to identify which pump may be the cause of reduced overall flow. Thus, it would be desirable to provide a system and method for continuously monitoring wear of pump casing liners so that repair can be performed in a timely manner.

Wear monitoring systems, in general, are known. For example, U.S. Pat. No. 6,945,098 to Olson discloses a wear detection system for use in determining wall thinning in hydrocyclone applications, U.S. Pat. No. 6,290,027 to Matsuzaki, U.S. Pat. No. 5,833,033 to Takanashi, and U.S. Pat. No. 4,274,511 to Moriya disclose systems for detecting wear of brake pads, and U.S. Pat. No. 3,102,759 to Stewart discloses a system for detecting wear of journal bearings. The problem with these systems is that they may not be as accurate as desired. This is because the systems employ wear sensors made of materials that have compositions and properties different from the compositions and properties of the components being monitored. Owing to such differences, the sensors may wear at a faster or slower rate than the monitored components. As will be appreciated, where sensor wear is not consistent with component wear, the accuracy of the monitoring system is adversely affected.

Thus, there remains a need for an improved wear monitoring system that can continuously monitor wear of pump casing liners so that repair can be effected in a timely manner. Such a system should overcome the deficiencies inherent in current systems, and should be highly accurate. It would also be desirable to provide a system and method for storing liner wear information so that wear trending can be accomplished.

SUMMARY OF THE DISCLOSURE

This disclosed wear detector is designed to detect erosion wear in a screw pump. This device detects wear in the idler bores. The idler bores are designed to provide an oil film build up with the idler rotors according to journal bearing theory. As such, under normal operating conditions the idler rotors do not come in contact with the idler bores, but rather they ride on an oil film. The disclosed wear detector is design to erode away at the same rate as the Babbitt lined pump bores when heavy debris is present. Therefore it is important that the sensor be made from a material that erodes at the same rate as the Babbitt material of the pump lining. The disclosed design can also detect film type failure modes. Film failure is where the pump's conditions change and the idlers come into contact with the idler bores.

A system for monitoring wear of pump casing liners is disclosed. The system may include a wear sensor disposed in proximity to the pump casing liner so that the sensor wears at substantially the same rate as the lining. A signal representative of the sensor wear is provided to a control system which logs the wear information and uses that information to signal a user when one or more predetermined wear thresholds are exceeded.

A system is disclosed for monitoring pump lining wear. The system may comprise a wear detector having a housing portion and a circuit portion. The wear detector may be disposed in a casing of a pump, where the pump has a casing liner. The housing portion may include a nose portion that is made from substantially the same material as the casing liner. The nose portion can be positioned flush with an inner surface of the casing liner adjacent a screw of the pump. The circuit portion can be disposed in or on the nose portion. The circuit portion may have at least one circuit loop electrically coupled to a conductor, and the conductor may be coupled to a controller for providing one or more signals to the controller representative of a thickness of the casing liner.

A system is disclosed for monitoring pump lining wear. The system may comprise a wear detector comprising a housing portion and a circuit portion, the wear detector disposed in a casing of a pump, the pump having a casing liner. The housing portion may have a nose portion that is made from substantially the same material as the casing liner. The nose portion may be positioned flush with an inner surface of the casing liner adjacent a screw of the pump. The circuit portion may be disposed in or on the nose portion. The circuit portion may have at least one circuit loop electrically coupled to a conductor. The conductor may be coupled to a controller to enable the controller to determine a thickness of the casing liner.

The circuit portion may comprise a flexible circuit including a plurality of conductive traces that form first and second circuit loops. The first circuit loop may be coupled to first and second contact openings, the second circuit loop may be coupled to the second contact opening and a third contact opening, and the first and second circuit loops may share a common ground. The first circuit loop may be longer than the second circuit loop such that the first circuit loop extends closer to the nose portion of the housing portion than the second circuit loop. When the nose portion is worn away by a first predetermined amount the first circuit loop may be broken, resulting in an open circuit configured to be sensed the controller. When the nose portion is worn away by a second predetermined amount the second circuit loop may be broken, resulting in an open circuit configured to be sensed by the controller.

The controller may be configured to recognize the opening of the first and second circuit loops as corresponding to respective first and second predetermined thickness reductions in the casing liner. The controller may include a processor and a memory, and may be configured to execute instructions for recognizing signals received from the wear detector as representative of one or more wear conditions of the casing liner. The memory may store data representative of the one or more wear conditions of the pump liner associated with time stamp data.

A wear detector is disclosed for monitoring pump lining wear. The wear detector may comprise a housing portion and a circuit portion. The housing portion may have a nose portion positionable flush with an inner surface of a pump casing liner adjacent a screw of a pump. The circuit portion may be disposed in or on the nose portion and may have at least one circuit loop electrically coupled to a conductor. The conductor may be coupled to a controller for providing one or more signals to the controller representative of a thickness of the casing liner. The circuit portion may comprise a flexible circuit including a plurality of conductive traces that form first and second circuit loops. The first circuit loop may be coupled to first and second contact openings, the second circuit loop is coupled to the second contact opening and a third contact opening, and wherein the first and second circuit loops share a common ground. The first circuit loop may be longer than the second circuit loop such that the first circuit loop extends closer to the nose portion of the housing portion than the second circuit loop. When the nose portion is worn away by a first predetermined amount the first circuit loop may be broken, resulting in an open circuit configured to be sensed the controller, and when the nose portion is worn away by a second predetermined amount the second circuit loop may be broken, resulting in an open circuit configured to be sensed by the controller.

A method is disclosed for monitoring pump lining wear. The method comprises: at a controller, determining a thickness of a pump casing liner based on signals received from a conductor associated with a wear detector; wherein the wear detector having a nose portion positioned flush with an inner surface of the pump casing liner, the nose portion made from substantially the same material as the pump casing liner, the wear detector having a circuit portion with at least one circuit loop disposed adjacent the nose portion, the at least one circuit loop electrically coupled to the conductor. The at least one circuit loop may comprise first and second circuit loops, the first circuit loop being longer than the second circuit loop such that the first circuit loop extends closer to the nose portion than the second circuit loop. The method may further comprise, at the controller, sensing a first open circuit condition when the nose portion is worn away by a first predetermined amount that breaks the first circuit loop and results in a first open circuit. The method may also comprise at the controller, sensing a second open circuit condition when the nose portion is worn away by a second predetermined amount that breaks the second circuit loop and results in a second open circuit. The controller may correlate the opening of the first and second circuit loops as corresponding to respective first and second predetermined thickness reductions in the pump casing liner.

BRIEF DESCRIPTION OF THE DRAWINGS

By way of example, a specific embodiment of the disclosed device will now be described, with reference to the accompanying drawings:

FIG. 2A is a cross-section view of a pump casing portion of the pump of FIG. 1 taken along line 2-2; FIG. 2B is a detail view of a liner portion of the pump casing of FIG. 2A;

FIG. 3 is an exploded isometric view of an exemplary wear sensor;

FIG. 5 is a plan view of an exemplary circuit portion of the wear sensor of FIG. 3;

FIG. 6A is a cutaway view of the circuit portion of FIG. 5; FIG. 6B is a detail cutaway view of a portion of the cutaway view of FIG. 6A;

DETAILED DESCRIPTION

Figure 1:
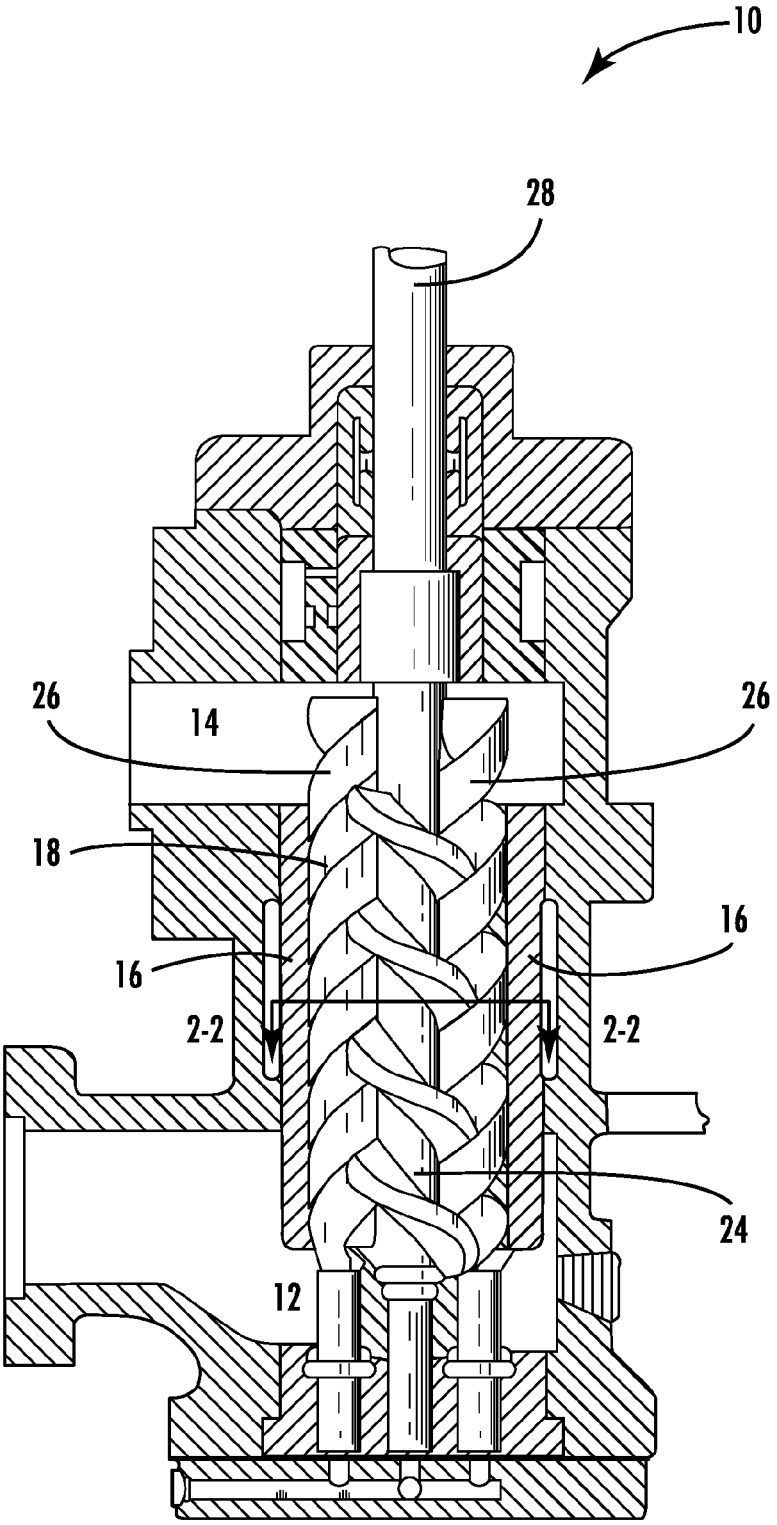
FIG. 1 is cross-section view of an exemplary three-screw pump.

Referring now to the drawings, FIG. 1 is a schematic cross-section of a screw pump 10. The pump 10 includes an inlet-suction end 12, an outlet-discharge end 14, and a casing 16 defining a screw channel 18 there-between. As illustrated in FIG. 2A, the screw channel 18 comprises a larger center bore 20 and a pair of smaller bores 22 juxtaposed on opposed sides of the center bore 20, for respectively receiving a drive screw 24 and a pair of idler screws 26. Operating power for the drive screw 24 is transmitted by means of a drive screw spindle 28 (FIG. 1), which is rotated by a motor or other drive unit (not shown). In the schematic pump 10 shown in FIG. 1, fluid is conveyed from left to right.

One or more inner surfaces of the pump casing 16 may be lined with a material that is different from the casing material to protect the pump casing 16 from damage during operation. FIG. 2B shows such a lining 30 disposed on the inner surfaces of the casing 16 adjacent one of the idler screws 26. In practical application, this lining 30 may be disposed on the inner surfaces of the casing 16 adjacent the idler screws 26 and the drive screw 24. In one embodiment, the lining 30 comprises Babbit metal. Babbitt metal is soft and has a structure is made up of small hard crystals dispersed in a softer metal, which makes it a metal matrix composite. As the Babbit metal wears, the softer metal erodes, which creates paths for lubricant between the hard high spots that provide the actual bearing surface. The lining 30 may be provided in any of a variety of desired thicknesses. In one embodiment, the thickness "T" of the lining 30 is about 3/16-inch.

During operation, when entrained solids pass between the screws 24, 26 and the liner 30, the screws and liner may become worn or damaged. To maintain desired performance, the screws and liner may be periodically replaced. Traditionally, the liner is replaced at the same time the screws are replaced, since direct inspection of the liner throughout the casing is difficult. Changing the liner, however, requires that the pump be taken out of service and shipped to a maintenance facility. The problem with such a procedure is that liner replacement is not always necessary. With the disclosed system, the user is provided with a constant indication of liner thickness, and thus, if the system indicates that the liner remains above a certain critical thickness when it is time for the screws to be replaced, then only screw replacement can be carried out. The benefit is that screw replacement can be performed in the field, whereas liner replacement must be performed in the shop. As will be appreciated, this can result in lower cost and impact on operations, resulting in lower overall life cycle cost for the pump.

Figure 4A:
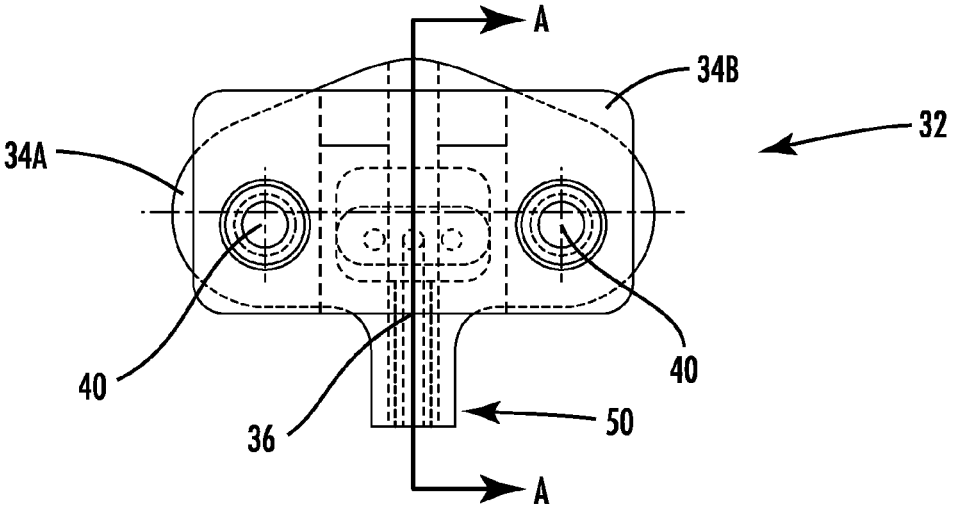
FIG. 4A is a transparent plan view of the wear sensor of FIG. 3.
Figure 4B:
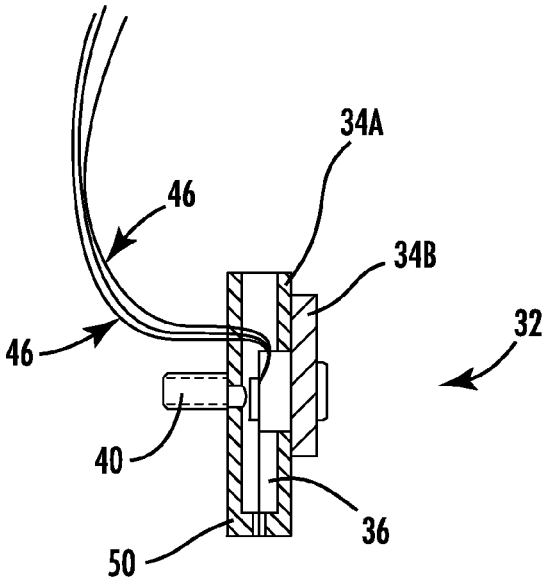
FIG. 4B is a cross-section view taken alone line 4B-4B of FIG. 4A.

Referring now to FIGS. 3-5, the wear sensor 32 may include a housing 34 and a wear circuit 36 disposed within the housing. In the illustrated embodiment, the housing 34 comprises first and second housing halves 34A, B and the wear circuit 36 comprises a flexible circuit containing a plurality of conductive traces 37. The housing halves 34A, B and the wear circuit 36 may be held together using a suitable adhesive, such as epoxy. First and second recesses 38A, B may be provided in the housing halves 34A, B to enable the wear sensor 32 to accept fasteners 40 for fastening the wear sensor to the pump casing 16 at an appropriate location, as will be described in greater detail later. Although the housing is shown as being two pieces, it will be appreciated that a single-piece housing could also be used.

As can be seen, the wear circuit 36 may have a first end 42 with a plurality of contact openings 44 for coupling to a plurality of conductors 46 (FIG. 4B) and a second end 48 that extends adjacent to a nose portion 50 of the first housing half 34A. A plurality of holes 52 are disposed in the wear circuit 36 between the conductive traces, to facilitate bonding of the circuit to the housing 34 (FIG. 5).

As can be seen in FIG. 5, the wear circuit 36 may include a plurality of conductive traces 37 which, in the illustrated embodiment, make up first and second circuit loops 37A, B. The first circuit loop 37A is coupled to contact openings 44A and 44B, while the second circuit loop 37B is coupled to contact openings 44B and 44C. The loops 37A, B share a common ground 44B. Although the illustrated embodiment shows two separate circuit loops, the wear circuit 36 could include greater or fewer circuit loops, as desired.

FIGS. 6A and 6B show additional detail of the wear circuit 36. Specifically, the wear circuit is shown as a laminate structure in which the conductive traces 37 and the contact openings 44 are sandwiched between first and second layers 54A, 54B of flexible material. In one embodiment, this flexible material is a polyimide. Other flexible laminates can also be used. The laminate structure is held together using a suitable adhesive, such as epoxy. The individual conductors 46 (FIG. 4B) can be connected to the contact openings 44 via soldering.

Figure 7:
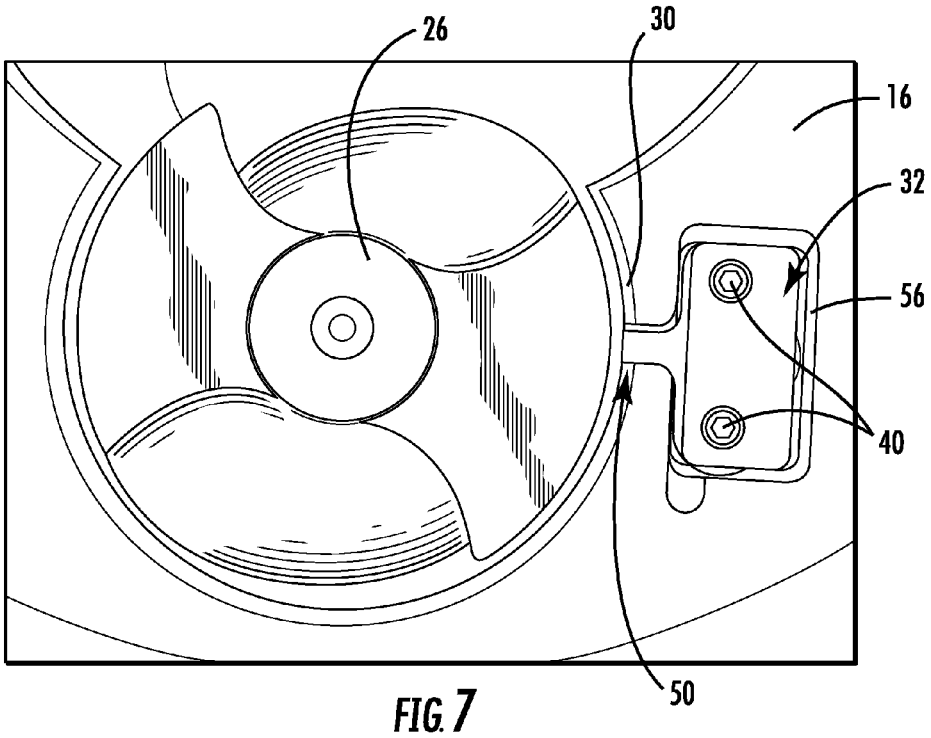
FIGS. 7-9 show the disclosed wear sensor installed in an exemplary pump casing.
Figure 8:
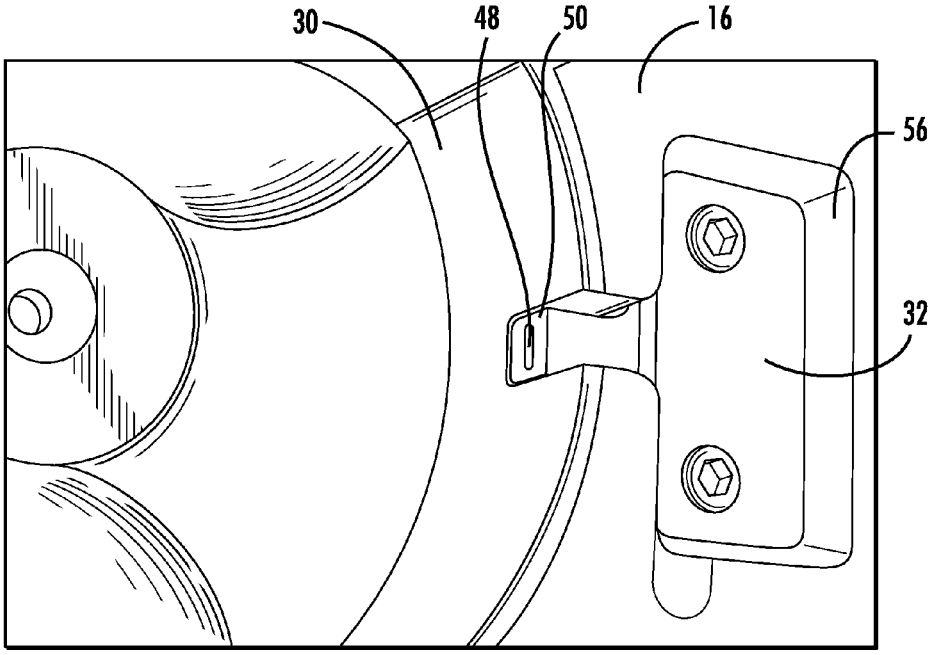
Figure 9:
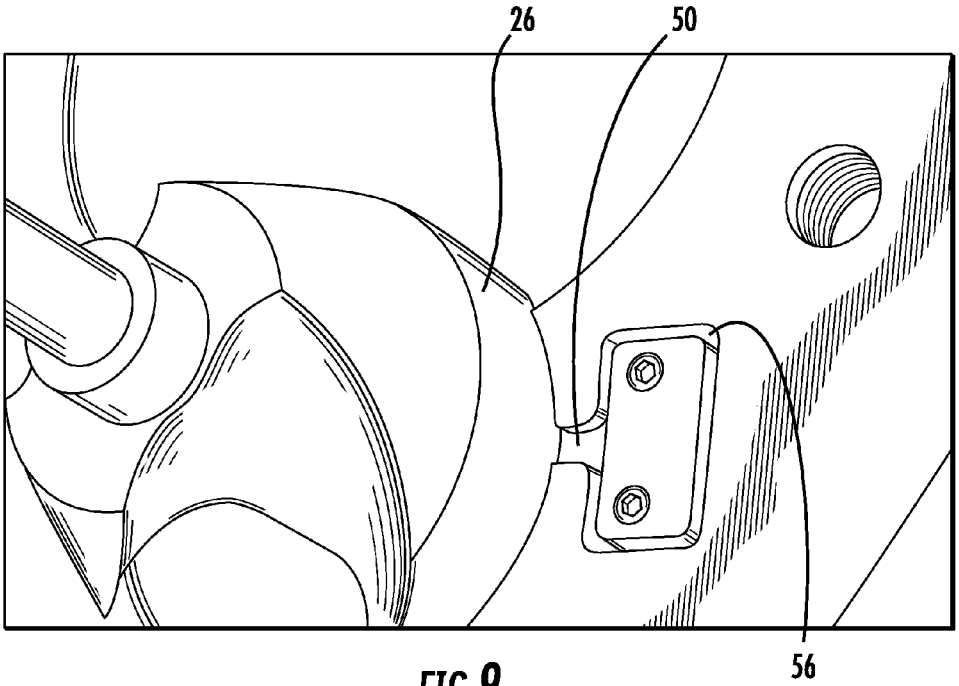

FIGS. 7-9 show the wear sensor 32 installed in an exemplary pump casing 16. The wear sensor 32 is shown disposed within a recess 56 formed in the casing 16 and is fixed to the casing via the fasteners 40. As can be seen, the sensor 32 is positioned so that the nose portion 50 of the sensor is substantially flush with the inner surface of the casing liner 30.

In one embodiment, the first and second housing halves 34A, B of the wear sensor 32 are made from the same material as the casing liner 30. Thus, in an exemplary embodiment the first and second halves 34A, B are made from Babbit metal of a similar composition as that of the casing liner 30. Because the housing is made from the same material as the casing liner 30, the nose portion 50 of the sensor will experience wear at substantially the same rate as the liner. As the nose portion 50 wears, so does the circuit 36 which is disposed in or on the nose portion 50. As a result, wear of the wear circuit is directly proportional to wear of the liner 30.

Referring back to FIG. 5, it can be seen that the first circuit loop 37A is longer than the second circuit loop 37B (i.e., the first circuit loop 37A extends closer to the second end 48 of the wear circuit 36 than does the second circuit loop 37B). Since the second end 48 of the wear circuit 36 is disposed adjacent to the nose portion 50 of the first housing half 34A, the second end 48 of the wear circuit will wear away at or about the same rate as the nose portion 50 (liner 30). As the second end 48 of the wear circuit is worn away by a first amount (identified as "T1" in FIG. 5), the first circuit loop 37A is broken, resulting in an "open circuit," which can be sensed by a monitoring controller. As wear progresses, the wear circuit 36 eventually wears away by a second amount "T2," and the second circuit loop 37B is broken, thus resulting in an "open circuit" which can be sensed for the second circuit loop.

The system may be configured to recognize the "opening" of each circuit 37A, B as corresponding to particular predetermined thickness reductions in the casing liner 30. In this way, the in situ thickness of the casing liner 30 can be continuously monitored, and the pump 10 can be taken off line and refurbished when the liner thickness reaches a critical value.

Figure 10:
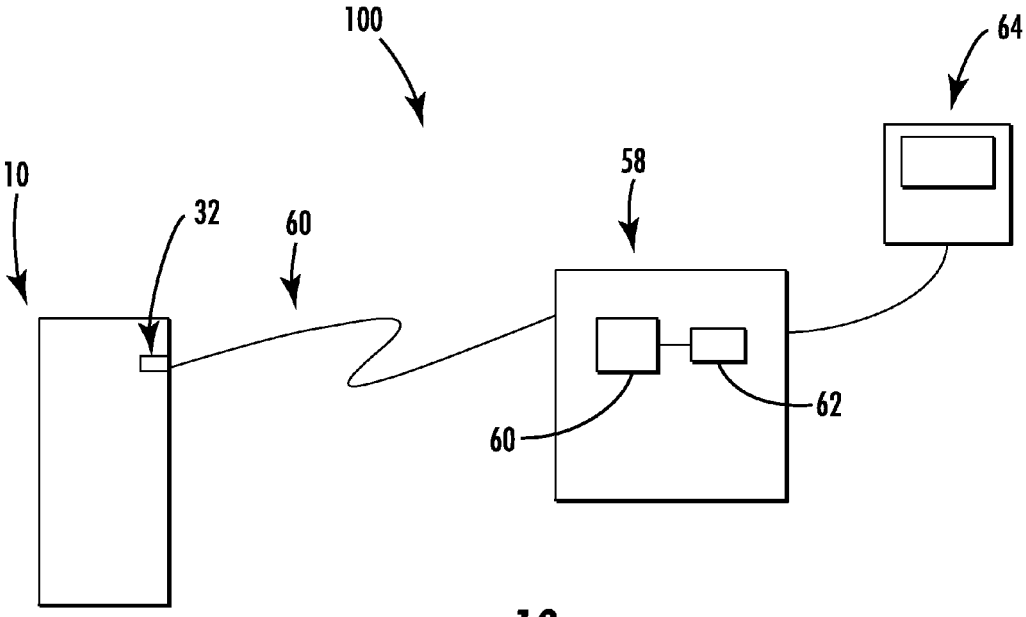
FIG. 10 is a block diagram of a system for monitoring pump casing liner wear using the disclosed wear sensor.

FIG. 10 shows a system 100 for monitoring pump liner wear. Wear sensor 32 is installed in pump 10, and conductors 46 are routed through the casing using an appropriate gland seal, such as a high pressure gland seal offered by Conax Technologies, 2300 Walden Avenue, Buffalo, N.Y. 14225. Signals from the conductors 46 may be communicated to a control box 58 via a hard-wired or wireless communication link 60. The control box 58 may include a processor 60 and associated memory 62. The processor may be configured to execute instructions for receiving input signals from the wear sensor 32 and for recognizing the signals as representative of one or more wear conditions of the pump liner 30. The memory 62 may be used to store data representative of the one or more wear conditions of the pump liner. Such data may also include time stamp data which can be used to develop wear trend information for the pump 10. In one embodiment, this wear trend information can be used to predict an end-of-life for the pump liner 30. The system 100 may also include a display 64 in communication with the control box 58. The display 64 may be used to display one or more pump liner conditions or warnings to a user. Visible and/or audible indications of pump liner condition may be included.

Figure 11:
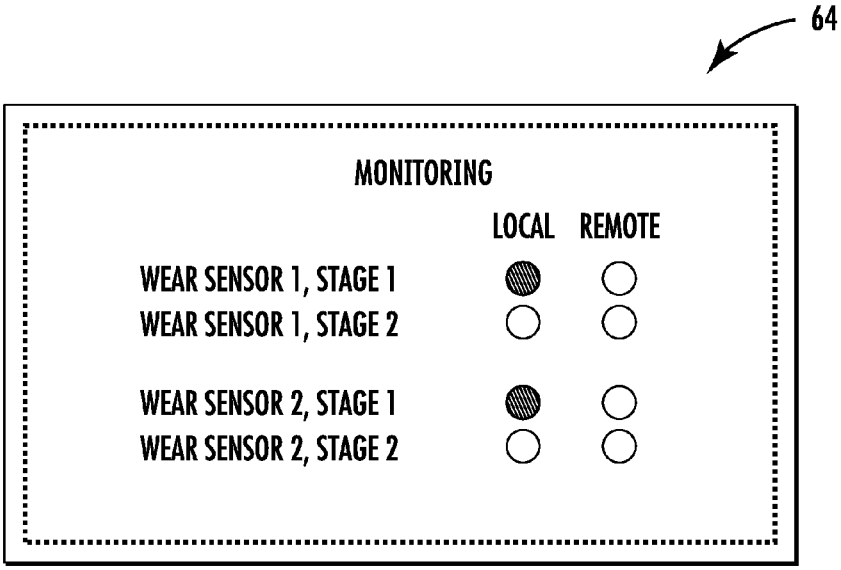
FIG. 11 is a diagram of an exemplary display for use in the system of FIG. 10.

FIG. 11 shows an exemplary display 64 for a system that includes a pair of wear sensors 32. More than one wear sensor may be used where the pump 10 has multiple idler screws 26. It will be appreciated that a multiplicity of wear sensors 32 can be disposed throughout the pump casing as desired, to provide information on the casing liner 30 at various locations throughout the pump.

The display 64 of FIG. 11 includes a visual indication of the wear state of first and second wear sensors 32. In the illustrated embodiment, a visual indication is provided indicating that a first predetermined thickness reduction in the liner 30 has been observed (termed "Stage 1"). This would, for example, correlate with the breaking of the first circuit loop 37A in each wear sensor. "Stage 2" does not display a warning condition, and thus the second circuit loop 37B in each wear sensor has not been breached.

As will be appreciated, in addition to this local display 64, a further remote display of data can also be provided. Further, an e-mail, fax or SMS text message can be sent to a predetermined address when one or more circuit loop breaks are sensed.

Figure 12:
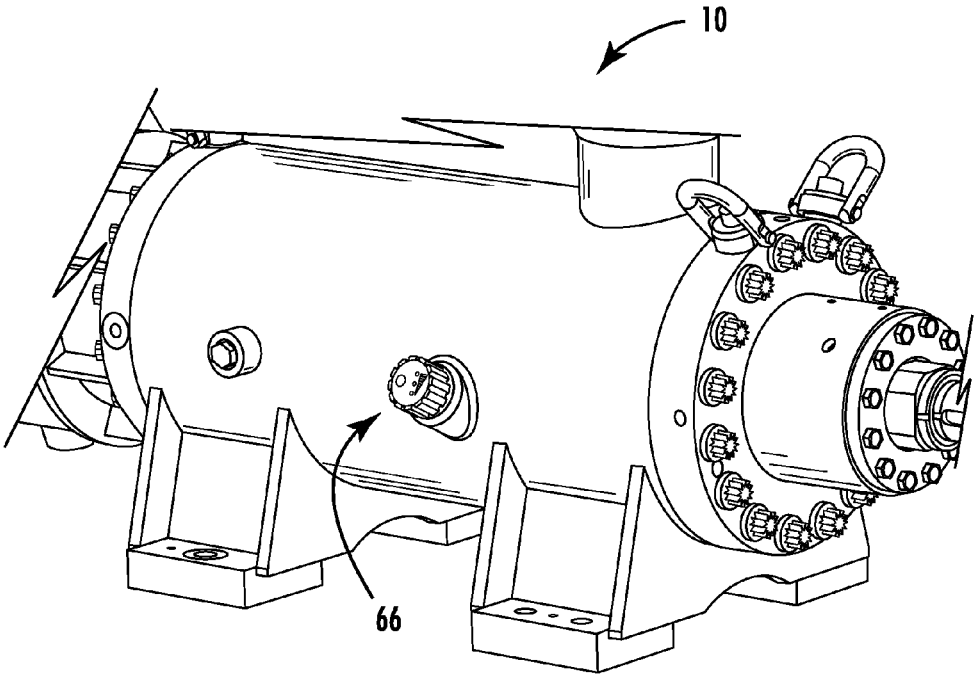
FIGS. 12 and 13 show a local readout for displaying pump lining condition.
Figure 13:
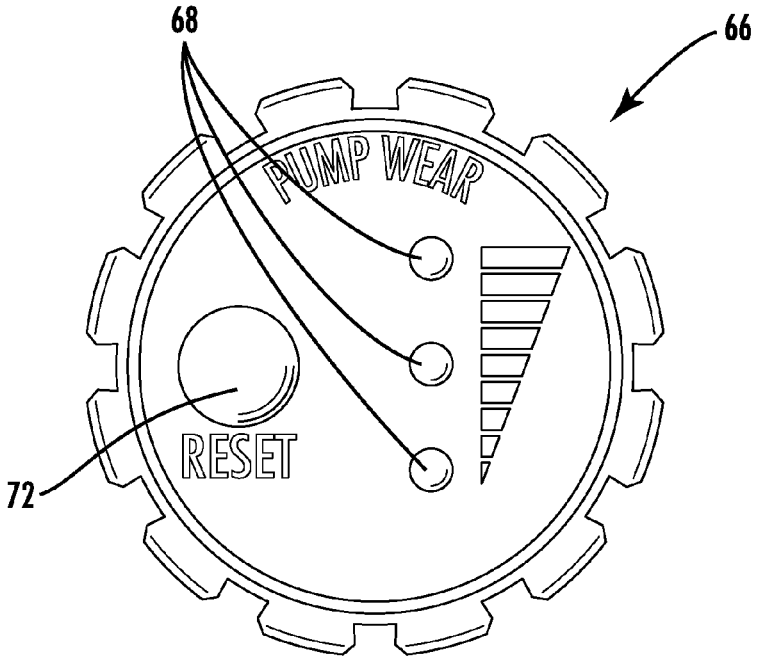

FIG. 12 shows an implementation of the disclosed wear sensor in which a local readout of lining condition is provided in lieu of a separate control box. In this embodiment, a local display 66 is provided, with LED's (light emitting diodes) 68 (FIG. 13) illuminating in sequence as each wear interval is reached (i.e., as each circuit loop is breached). A reset button 72 can be provided to reset the display 68 when a new wear sensor 32 is installed. The display 66 of this embodiment can be locally powered by an internal battery or small solar cell. In some embodiments, additional digital outputs can be provided to connect to external data acquisition components.

Based on the foregoing information, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention. Accordingly, while the present invention has been described herein in detail in relation to its preferred embodiment, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements; the present invention being limited only by the claims appended hereto and the equivalents thereof. Although specific terms are employed herein, they are used in a generic and descriptive sense only and not for the purpose of limitation.

What is claimed is:

1. A system for monitoring pump lining wear, comprising:

a wear detector comprising a housing portion and a circuit portion, wherein the housing portion includes first and second housing halves having respective recesses for accepting fasteners for fastening the wear detector to a pump casing, and wherein the circuit portion is disposed intermediate the first and second housing halves;

the wear detector disposed in a casing of a pump, the pump having a casing liner;

the housing portion having a nose portion that is made from substantially the same material as the casing liner, the nose portion positioned flush with an inner surface of the casing liner adjacent a screw of the pump;

the circuit portion disposed in or on the nose portion, the circuit portion having at least one circuit loop electrically coupled to a conductor, the conductor coupled to a controller to enable the controller to determine a thickness of the casing liner;

a processor and a memory, the processor configured to execute instructions for recognizing signals received from the wear detector as representative of one or more wear conditions of the casing liner, wherein the memory stores data representative of the one or more wear conditions of the casing liner associated with time stamp data, the processor further configured to predict an end-of-life for the casing liner based on the stored data.

2. The system of claim 1, wherein the circuit portion comprises a flexible circuit including a plurality of conductive traces that form first and second circuit loops.

3. The system of claim 2, wherein the first circuit loop is coupled to first and second contact openings, the second circuit loop is coupled to the second contact opening and a third contact opening, and wherein the first and second circuit loops share a common ground.

4. The system of claim 2, wherein the first circuit loop is longer than the second circuit loop such that the first circuit loop extends closer to the nose portion of the housing portion than the second circuit loop.

5. The system of claim 1, wherein when the nose portion is worn away by a first predetermined amount the first circuit loop is broken, resulting in an open circuit configured to be sensed by the controller.

6. The system of claim 5, wherein when the nose portion is worn away by a second predetermined amount the second circuit loop is broken, resulting in an open circuit configured to be sensed by the controller.

7. The system of claim 6, wherein the monitoring controller is configured to recognize the opening of the first and second circuit loops as corresponding to respective first and second predetermined thickness reductions in the casing liner.

8. The system of claim 1, wherein the housing portion comprises Babbit metal.

9. A wear detector for monitoring pump lining wear, comprising:

a housing portion and a circuit portion, wherein the housing portion includes first and second housing halves having respective recesses for accepting fasteners for fastening the wear detector to a pump casing;

the housing portion having a nose portion positionable flush with an inner surface of a pump casing liner adjacent a screw of a pump, the nose portion being made from substantially the same material as the casing liner;

the circuit portion disposed in or on the nose portion, the circuit portion having at least one circuit loop electrically coupled to a conductor, the conductor coupled to a controller for providing one or more signals to the controller representative of a thickness of the casing liner;

a processor and a memory, the processor configured to execute instructions for recognizing signals received from the circuit portion as representative of one or more wear conditions of the casing liner, wherein the memory stores data representative of the one or more wear conditions of the casing liner associated with time stamp data, the processor further configured to predict an end-of-life for the casing liner based on the stored data.

10. The wear detector of claim 9, wherein the circuit portion comprises a flexible circuit including a plurality of conductive traces that form first and second circuit loops.

11. The wear detector of claim 10, wherein the first circuit loop is coupled to first and second contact openings, the second circuit loop is coupled to the second contact opening and a third contact opening, and wherein the first and second circuit loops share a common ground.

12. The system of claim 10, wherein the first circuit loop is longer than the second circuit loop such that the first circuit loop extends closer to the nose portion of the housing portion than the second circuit loop.

13. The system of claim 9, wherein when the nose portion is worn away by a first predetermined amount the first circuit loop is broken, resulting in an open circuit configured to be sensed the controller, and when the nose portion is worn away by a second predetermined amount the second circuit loop is broken, resulting in an open circuit configured to be sensed by the controller.

* * * * *